US009017051B2

(12) United States Patent
Figoni

(10) Patent No.: US 9,017,051 B2
(45) **Date of Patent: *Apr. 28, 2015**

(54) ROTARY VACUUM PUMP WITH A DISCHARGE COMPENSATING CHANNEL

(71) Applicant: Oerlikon Leybold Vacuum GmbH, Cologne (DE)

(72) Inventor: Eric Figoni, Erome (FR)

(73) Assignee: Oerlikon Leybold Vacuum GmbH, Cologne (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/900,843

(22) Filed: May 23, 2013

(65) Prior Publication Data

US 2013/0251578 A1 Sep. 26, 2013

Related U.S. Application Data

(62) Division of application No. 11/988,408, filed as application No. PCT/EP2006/063748 on Jun. 30, 2006, now Pat. No. 8,469,684.

(30) Foreign Application Priority Data

Jul. 7, 2005 (DE) ..... 10 2005 031 718

(51) Int. Cl.
*F04C 29/02* (2006.01)
*F04C 18/344* (2006.01)
(Continued)

(52) U.S. Cl.
CPC ..... *F04C 29/028* (2013.01); *F04C 18/3442* (2013.01); *F04C 25/02* (2013.01);
(Continued)

(58) Field of Classification Search
CPC ..... F04C 27/02; F04C 28/06; F04C 29/028; F04C 29/128
USPC ..... 418/1, 97
See application file for complete search history.

(56) References Cited

U.S. PATENT DOCUMENTS 3,040,973 A 6/1962 Wessling
3,053,439 A 9/1962 Brill
(Continued)

FOREIGN PATENT DOCUMENTS

DE 1123076 2/1962
DE 2401177 7/1975
(Continued)

OTHER PUBLICATIONS

Affidavit Production and Logistics Manager, E2.0 by Angelo Isella w/Exhibits E2.1 to E2.8 Affidavit filed Dec. 20, 2011, Provided in U.S. Appl. No. 11/988,408.
(Continued)

*Primary Examiner* — Mary A Davis
(74) *Attorney, Agent, or Firm* — Fay Sharpe LLP

(57) ABSTRACT

A rotary vacuum pump includes a suction chamber (12) in a housing (10). A rotor (14) is eccentrically mounted in the suction chamber (12). Sliding vanes (18) are connected to the rotor (14). Further, a discharge channel (30) is connected to the suction chamber (12) and to an oil chamber (32). A valve (38) is disposed between the discharge channel (30) and the oil chamber (32) in order to prevent the medium from flowing back from the oil chamber (32) into the suction chamber (12). At least one compensating channel (50) is connected to the discharge channel (30) and to the oil chamber (32).

10 Claims, 1 Drawing Sheet

(51) Int. Cl.

| | |
|---|---|
| ***F04C 27/02*** | (2006.01) |
| ***F04C 29/12*** | (2006.01) |
| *F04C 25/02* | (2006.01) |
| *F04C 28/06* | (2006.01) |
| *F04C 28/28* | (2006.01) |

(52) U.S. Cl.

CPC ..... *F04C 27/02* (2013.01); *F04C 28/06* (2013.01); *F04C 28/28* (2013.01); *F04C 29/128* (2013.01); *F04C 2220/10* (2013.01)

(56) References Cited

U.S. PATENT DOCUMENTS

| | | | |
|---|---|---|---|
| 3,301,474 | A | 1/1967 | Buchel |
| 3,326,456 | A | 6/1967 | Le Blanc, Jr. |
| 3,421,688 | A | 1/1969 | Spooner |
| 3,782,868 | A | 1/1974 | Le Blanc, Jr. |
| 4,389,170 | A | 6/1983 | Hayashi |

FOREIGN PATENT DOCUMENTS

| | | | |
|---|---|---|---|
| DE | 2755328 | A1 | 9/1978 |
| DE | 3043054 | | 6/1981 |
| DE | 3616515 | A1 | 11/1987 |
| DE | 4016014 | A1 | 12/1990 |
| DE | 3933047 | A1 | 4/1991 |
| DE | 10147324 | A1 | 5/2002 |
| DE | 10227772 | A1 | 1/2003 |
| EP | 1108892 | A2 | 6/2001 |
| EP | 1890040 | B1 | 6/2012 |
| GB | 925009 | | 5/1963 |
| GB | 1556643 | | 11/1979 |
| GB | 2380523 | A | 4/2003 |
| JP | 53-43209 | S | 9/1977 |
| JP | 57172482 | | 10/1982 |
| JP | 2002349458 | A | 12/2002 |
| JP | 49-10005 | | 4/2012 |
| WO | 2004024985 | | 3/2004 |
| WO | 2004444431 | A2 | 5/2004 |
| WO | 2004444431 | A3 | 5/2004 |

OTHER PUBLICATIONS

E18.1—Instruction manual of the Leybold pump Sogevac SV40 BI (cover) (Apr. 2005) (parallel German/English).

E18.2—Bulletin of the Czech Vacuum Society (2004) (parallel Czech/English).

E18.3.1,E18.3.2 and E18.3.3—photographs of Sogevac SV40 BI according to E18.1 and E18.2 (No Text).

E19.2—extract of the spare parts catalogue of BMW (2007).

E19.4—invoice (Jul. 2013).

E19.6—further extract of the spare parts catalogue of BMW (2007).

E19.7—plate of the spare parts catalogue of BMW (May 2003).

Translation of pp. 9-11 of E17—Literature Survey "BundesmInisterium fUr Forschung und Technologie"—(1984).

Translation of E18.2'—German translation of parts of the Bulletin of the Czech Vacuum Society (2004).

Translation of A2—Excerpt Wutz Handbuch Vakuumtechnik (Sections 7.3.5 & 7.3.5.1; p. 268) (2004).

ROTARY VACUUM PUMP WITH A DISCHARGE COMPENSATING CHANNEL

This application is a Divisional of U.S. application Ser. No. 11/988,408, filed Jul. 10, 2009, which is a 371 of PCT/EP2006/063748, filed Jun. 30, 2006, and claims the benefit of priority of DE 10 2005 031 718.9, filed Jul. 7, 2005 in Germany.

BACKGROUND

The invention relates to a rotary vacuum pump.

Rotary vacuum pumps comprise a suction chamber arranged in a housing. Within the housing, a rotor is eccentrically arranged. Normally, the rotor has two or more sliding vanes connected thereto which are arranged in vane slots. During rotation, the sliding vanes will be pressed against an inner wall of the suction chamber under the effect of the centrifugal force. For generating a vacuum, a suction opening of the rotary vacuum pump is connected to the space wherein the vacuum is to be generated. Due to the eccentricity of the rotor and the varying size of the chambers formed between the sliding vanes, the medium will be conveyed through the discharge channel. For lubrication purposes and also in order to guarantee a good sealing of the sliding vanes on the inner wall of the suction chamber, there always exists a certain quantity of oil for generating an oil film in the suction chamber. Since, for this reason, the discharged medium is mixed with oil, the discharge channel normally extends from the suction chamber into an oil chamber.

In case of a sudden stoppage of the rotary vacuum pump, e.g. due to an impact, this has the consequence that the suction chamber will be filled with oil via the lubricant supply. This will cause an increased moment of rotation and an increased development of noise when the pump is started the next time. Because of the increased moment of rotation, it may happen that the sliding vanes are damaged. Further still, a risk exists that oil could enter the chamber which is to be subjected to a vacuum, and thus could cause damage therein. It is therefore required that, after a stop, the suction chamber of the rotary vacuum pump is brought to atmospheric pressure so as to avoid an inflow of lubricant. To obtain this effect, it is known to provide a bore which is equipped with a closure means and is connected to the suction chamber. This is a relatively complex measure, involving the provision of a separately controllable closure means which must fulfill high requirements regarding its leak-tightness. Further, in cases such as a power fall-out, proper control of the closure means is not guaranteed anymore.

It is an object of the invention to provide a rotary vacuum pump wherein a filling of the suction chamber is prevented by constructionally simple measures.

SUMMARY

In the rotary vacuum pump according to one aspect, the suction chamber is connected to an oil chamber via a discharge channel, wherein a valve means is provided between the oil chamber and the discharge channel. The valve means is effective to prevent a backflow of medium, i.e. usually a mixture of oil and air, from the oil chamber into the suction chamber. There is further provided a compensating channel which connects the discharge channel to a region where substantially atmospheric pressure prevails. Preferably, the compensating channel is connected to an air zone of the oil chamber, the air zone of the oil chamber being that region of the oil chamber which is located above the oil bath and which substantially contains air, or air enriched with oil, as the case may be. The compensating channel is formed as a partially covered groove, for example, in a flange of the housing.

By the provision of such a compensating channel in combination with a valve means located between the oil chamber and the discharge channel, it is accomplished that, in operation, the medium is pressed out of the suction chamber into the discharge channel, with the medium—normally a mixture of air and oil—entering the oil chamber through the valve means. Part of the oil existing in the medium is pressed into the compensating channel, thus sealing the latter. During operation, it is thus safeguarded that no fresh air will be sucked in via the compensating channel and respectively no air with atmospheric pressure will enter the compensating channel. In case of failure of the rotary vacuum pump or also of an intended stoppage of the rotary vacuum pump, air is sucked through the compensating channel due to the lower pressure existing in the suction chamber. This will effect a fast pressure compensation in the suction chamber so that the suction chamber is quickly brought to atmospheric pressure. As a result, the suction chamber will not be filled with oil via the lubricant supply. Thereby, the disadvantages of an increased moment of rotation at the next start and of a resultant possible damage to the sliding vanes are avoided. Also avoided thereby is a leakage of oil or lubricant into the space where the vacuum is to be generated.

The length of time required for compensating the pressure in the suction chamber is very short.

A further problem of rotary vacuum pumps resides in the increased noise development which is to be observed when the rotor is operated at rotational speeds in the limit range. For reducing the noise development, the housing is formed with a small opening in its compression region, allowing for inflow of air. Generated thereby is an oil emulsion which is effective to reduce the noise development. Since the air supply is very inaccurate and thus also the degree of the emulsion of the oil is inaccurate, the noise development can be reduced only to a slight extent.

By the provision of the compensating channel, a controlled and defined emulsifying of the oil is achieved. As described above, the compensating channel will at least partially be filled with oil while the medium is conveyed into the discharge channel from a region of the suction chamber between two adjacent sliding vanes. When, thereafter, the lagging sliding vane passes the opening of the discharge channel that is connected to the discharge channel, the oil supply stored in the compensating channel will be conveyed into this space. In the process, a small quantity of air is sucked along from the compensating channel so that the oil is emulsified. Particularly by a suitable number and shape of the compensating channels, and in dependence from the lubricant used, a good emulsifying of the lubricant can be guaranteed. Thus, the provision of at least one compensating channel is further effective to reduce the noise development also in limit ranges of the rotational number of the rotary vacuum pump.

Due to the small cross-sectional area of the at least one compensating channel, it is safeguarded that only a small quantity of air will enter the pump. Particularly it is rendered possible, by suitable selection of the number and of the cross-sectional area as well as the shape of the at least one compensating channel, to determine the quantity of oil temporarily stored in the compensating channel or channels as well as the sucked-in air quantity.

According to a particularly preferred embodiment, the compensating channel or the compensating channels is/are formed as a groove in the housing, said groove being partially covered. This has the advantage that the compensating channel can be produced in a simple manner. Preferably, the grooves are provided in a flange face of the housing, which face is arranged towards the oil chamber while, with the oil chamber fastened to the flange, the grooves are preferably arranged internally of the oil chamber. In this regard, it is particularly preferable if the grooves are covered by a valve tongue of the valve means so that the single groove or the grooves is/are covered by a small inlet opening connected to the air zone of the oil chamber.

Preferably, it is with the aid of the valve tongue which, if required, also covers the grooves, that the discharge channel will be opened and closed. For this purpose, the valve tongue is formed of an elastic, resilient material.

A particularly good sealing of the valve tongue can be obtained if that region of the valve tongue which seals the discharge channel is arranged in an oil bath, thus generating an additional press-on pressure. As a result of the increased sealing effect, a more extensive and efficient evacuation can be performed.

BRIEF DESCRIPTION OF THE DRAWINGS

Embodiments of the invention will now be described in greater detail with reference to the drawings in which.

DETAILED DESCRIPTION

Figure 1:
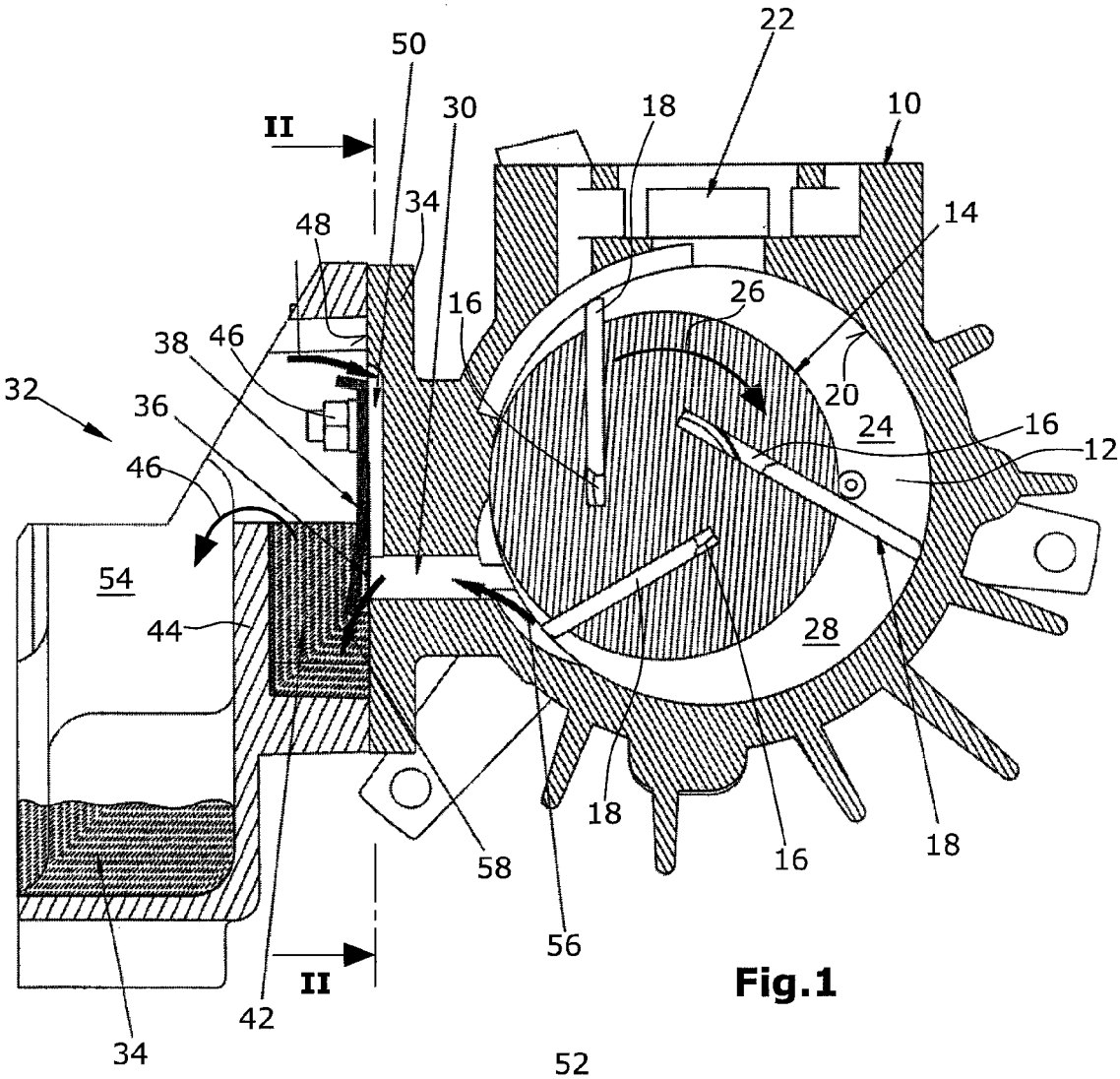
FIG. 1 shows a schematic sectional view of a rotary vacuum pump.

A rotary vacuum pump comprises a housing 10. Internally of housing 10, a rotor 14 is arranged in a suction chamber 12. In the illustrated embodiment, rotor 14 comprises three sliding-vane slots 16 with a respective sliding vane 18 arranged in each of them. Due to the rotation of rotor 14, the sliding vanes 18 are pressed against an inner wall 20 of the suction chamber by the action of the centrifugal force.

Via a suction opening 22 connected to the space which is to be evacuated, medium is sucked from the to-be-evacuated space into a first region 24 of suction chamber 12. This region 24 of suction chamber 12 is delimited by two adjacent sliding vanes 18. A region 28 of suction chamber 12 arranged before said region 24 in the direction of rotation 26 will be reduced in size by the rotation of rotor 14 so that the medium arranged therein will be compressed. Via a discharge channel 30, the medium is conveyed from region 28 out of suction chamber 12 in the direction of an oil chamber 32.

Oil chamber 32 is fastened on a flange 34 of the housing 10 of the rotary vacuum pump. Oil chamber 32 comprises an oil space or oil bath 34 provided to collect the oil which is supplied via discharge channel 30 particularly together with the air taken from the to-be-evacuated space.

A discharge opening 36 of discharge channel 30 is provided with a valve means 38. In the particularly preferred embodiment illustrated herein, said valve means is an elastic valve tongue which is attached to the flange 34 of housing 10, e.g. with the aid of a bolt or nut 40. With particular preference, it is provided that, in the region of discharge opening 36, the valve tongue is arranged in an oil bath 42. For this purpose, a separate oil space is formed in oil chamber 32 by means of a partition wall 44, wherein, in the filled condition of said oil space, the oil will flow in the direction indicated by arrow 46. By the provision of an oil bath 42, pressure is exerted on a rear side of the valve tongue, i.e. the side of the valve tongue facing towards oil bath 42. Thereby, the leak-tightness of valve means 38 is increased.

Figure 2:
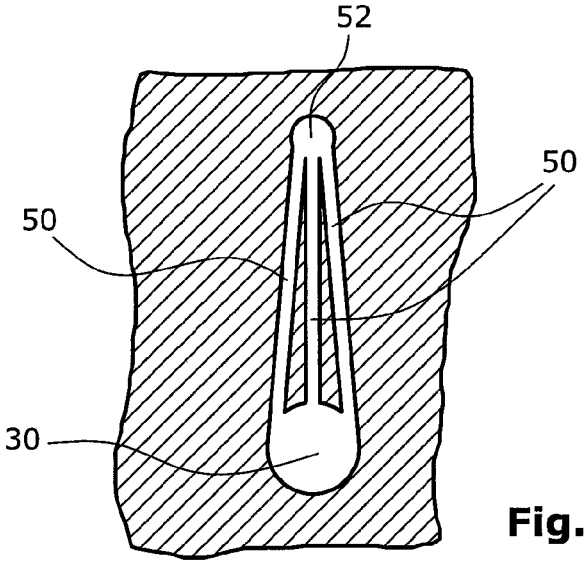
FIG. 2 shows a schematic sectional view taken along the line II-II in FIG. 1.

A flange face 48 facing towards oil chamber 32 has preferably plural compensating channels 50 provided therein. Said compensating channels 50 are formed by grooves which are arranged in the flange face 48 and are covered by the valve tongue 38 that is located in this region. In this configuration, the incomplete grooves are covered by the valve tongue so that an inlet opening 52 is formed which connects to the air zone 54 of oil chamber 32. Preferably, as illustrated in FIG. 2, a plurality of compensating channels 50 are provided, preferably arranged in a fan-shaped configuration originating from inlet opening 52.

Thus, by rotation of rotor 14, medium enriched with oil will be conveyed from region 28 in the direction of arrow 56 into discharge channel 30. Under the effect of the pressure, the valve tongue is pressed back, causing the medium to enter the oil bath 42 and respectively the oil chamber 32 while moving in the direction of arrow 58. In the process, a part of the oil is pressed into the compensating channels 50 and will thus generate a sealing effect.

As soon as said region 28 has been substantially evacuated, the oil supply existing in the channels 50 will be sucked into discharge channel 30 together with a small quantity of air which is sucked in via opening 52 from the air zone 54 of oil chamber 32. Under the effect of the air entrained, an emulsifying of the oil and thus a noise reduction are obtained.

In case of stoppage of the pump, e.g. due to failure, air will be sucked via opening 52 and compensating channels 50 from air zone 54 into suction chamber 12 so that a pressure compensation is generated and suction chamber 12 is brought substantially onto atmospheric pressure. In this manner, it is safeguarded that no lubricant or in the worst case only slight quantities thereof can enter the suction chamber. It is thus prevented that the suction chamber 12 is filled up with lubricant.

As a result of the oil flow or oil circulation in the region of valve means 38, particularly of the valve tongue, formation of deposits in this region is reliably prevented. Particularly, contamination of valve means 38 is avoided. Thereby, jamming of valve means 38 is prevented. Further, a good sealing effect is guaranteed, and it is prevented that the degree of leak-tightness of the valve might take an influence on the performance of the pump.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A rotary vacuum pump comprising:

a housing including a suction chamber, a rotor eccentrically mounted in the suction chamber, sliding vanes connected to the rotor for displacement therein, a discharge channel connected to the suction chamber and to an oil chamber, a valve arranged between the oil chamber and the discharge channel to prevent a backflow of medium from the oil chamber into the suction chamber, at least one compensating channel connected to the discharge channel and a zone at atmospheric pressure, wherein the at least one compensating channel is formed as a partially covered groove, and a structure which covers a portion of the at least one compensating channel such that the at least one compensating channel has fluid contact with oil in the oil chamber.

2. The rotary vacuum pump according to claim 1, wherein the groove is defined in a flange of the housing.

3. The rotary vacuum pump according to claim 1, wherein the groove of the at least one compensating channel is partially covered by a portion of the valve.

4. The rotary vacuum pump according to claim 3, wherein the valve includes an elastically deformable valve tongue which partially covers said groove forming the at least one compensating channel.

5. The rotary vacuum pump according to claim 1, wherein the at least one compensating channel is arranged in such a manner that, after completion of the discharge of medium from the suction chamber, the at least one compensating channel supplies oil for the subsequent compression of medium in the suction chamber.

6. The rotary vacuum pump according to claim 1, wherein the at least one compensating channel includes a plurality of grooves connected to each other adjacent a channel inlet opening connecting to the zone at atmospheric pressure such that the compensating channel is in fluid contact with the oil in the oil chamber via air in the zone at atmospheric pressure.

7. The rotary vacuum pump according to claim 1, wherein the valve is arranged in an oil bath and is disposed to close the discharge channel.

8. The rotary vacuum pump according to claim 1, wherein an upper end of the at least one compensating channel is connected to an air zone of the oil chamber and a lower end of the at least one compensating channel is connected with the discharge channel.

9. The rotary vacuum pump according to claim 1, wherein a lower end of the at least one compensating channel is connected to the discharge channel at a discharge end of the discharge channel adjacent the valve and below a level of oil in the oil chamber such that the compensating channel has fluid contact with the oil in the oil chamber.

10. A rotary vacuum pump comprising:

a housing including a suction chamber, a rotor eccentrically mounted in the suction chamber, sliding vanes connected to the rotor for displacement therein, a discharge channel connected to the suction chamber and to an oil chamber, a valve arranged between the oil chamber and the discharge channel to prevent a backflow of medium from the oil chamber into the suction chamber, at least one compensating channel having an upper end connected to an air zone of the oil chamber and a lower end connected with the discharge channel, wherein the at least one compensating channel is formed as a partially covered groove, and a structure which covers a portion of the at least one compensating channel between the upper and lower end such that the at least one compensating channel has fluid contact with oil in the oil chamber.

* * * * *